United States Patent [19]

Michel et al.

[11] Patent Number: 4,470,723

[45] Date of Patent: Sep. 11, 1984

[54] OSCILLATABLE MARINE INSTALLATION AND METHOD FOR ITS CONSTRUCTION

[75] Inventors: Dominique Michel; Jean G. M. Martin, both of Paris; Vincent F. P. Foglia, Aulnay sur Bois; François G. Sedillot, Velizy, all of France

[73] Assignee: Compagnie General pour les Developpements Operationnels des Richness Sous-Marines "C. G. Doris", France

[21] Appl. No.: 219,498

[22] Filed: Dec. 23, 1980

[30] Foreign Application Priority Data

Dec. 27, 1979 [FR] France ..... 79 31842
Mar. 18, 1980 [FR] France ..... 80 06034

[51] Int. Cl.[3] ..... E02B 17/00; E02D 5/54; E21B 7/128; F16C 11/00

[52] U.S. Cl. ..... 405/202; 405/205; 405/227; 403/132; 403/135; 175/7

[58] Field of Search ..... 405/202–207, 405/224, 227; 175/9, 7; 166/355; 403/132, 133, 135, 140

[56] References Cited

U.S. PATENT DOCUMENTS

| | | | |
|---|---|---|---|
| 3,522,709 | 8/1970 | Vilain | 405/202 |
| 3,559,410 | 2/1971 | Blenkarn et al. | 175/7 X |
| 3,670,515 | 6/1972 | Lloyd | 405/202 |
| 3,766,582 | 10/1973 | Lloyd et al. | 405/202 X |
| 4,000,624 | 1/1977 | chow | 405/204 |
| 4,069,682 | 1/1978 | Taylor et al. | 405/202 |
| 4,126,010 | 11/1978 | Michel et al. | 175/9 X |
| 4,158,517 | 6/1979 | Foglia | 405/202 |
| 4,214,843 | 7/1980 | Rohde . | |

FOREIGN PATENT DOCUMENTS

| | | | |
|---|---|---|---|
| 712337 | 6/1965 | Canada | 403/132 |
| 2157355 | 5/1973 | Fed. Rep. of Germany | 403/132 |

*Primary Examiner*—Cornelius J. Husar
*Assistant Examiner*—Nancy J. Stodola
*Attorney, Agent, or Firm*—Wigman & Cohen

[57] ABSTRACT

An oscillatable marine installation comprises a concrete and steel lattice shaft supported by means of a demountable pivot joint on a base fixed to the-sea-bed and including an anti-torque device. The pivot joint is made up of three parts: a casing fixed to the shaft, a part-spherical housing fixed to the base, and a pivot member. The pivot member has an upper part cooperating with the casing, a flange which can be fixed to the casing, and a lower part-spherical part housing which supports a resilient assembly and a bush fixed on the housing. The anti-torque device comprises a universal joint, concentric with the pivot joint. Two opposite pivots of the crosspiece of the universal joint are supported by the lower part of the shaft and the other two pivots by the base. At least two opposite pivots have damping devices and the pivots supported by the base are mounted on supports the height of which can be adjusted.

6 Claims, 38 Drawing Figures

FIG.:7
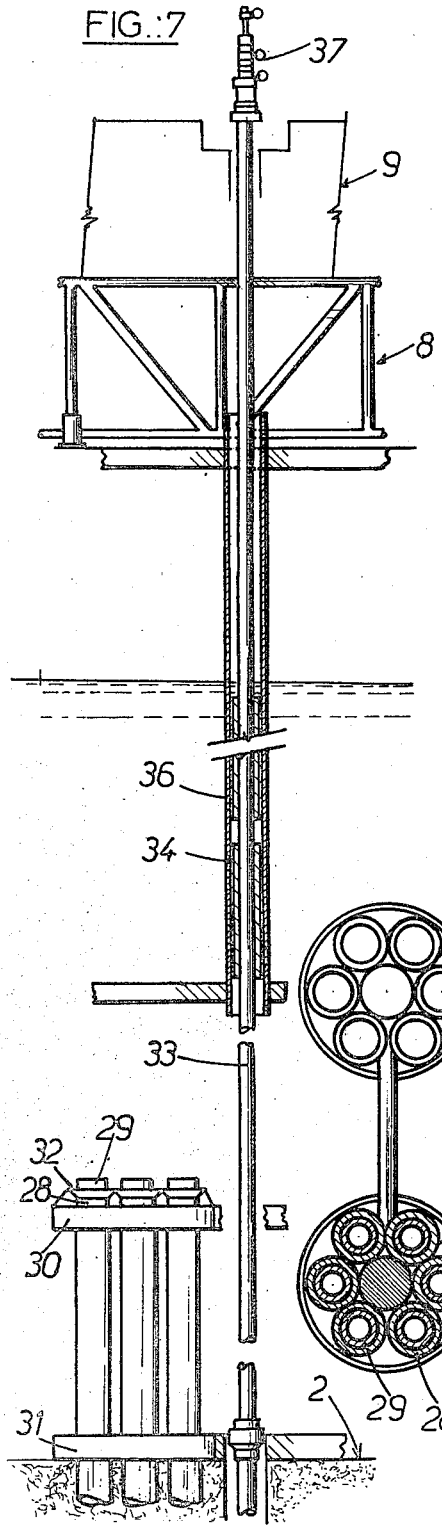
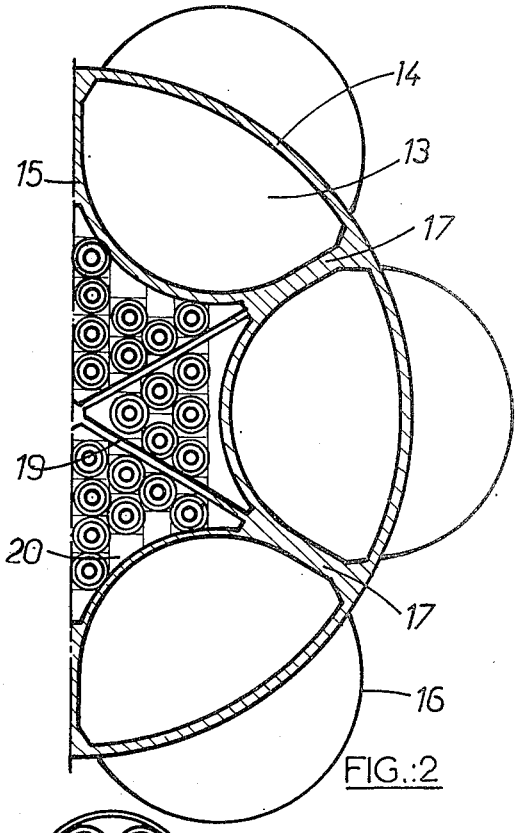
FIG.:2
FIG.:6
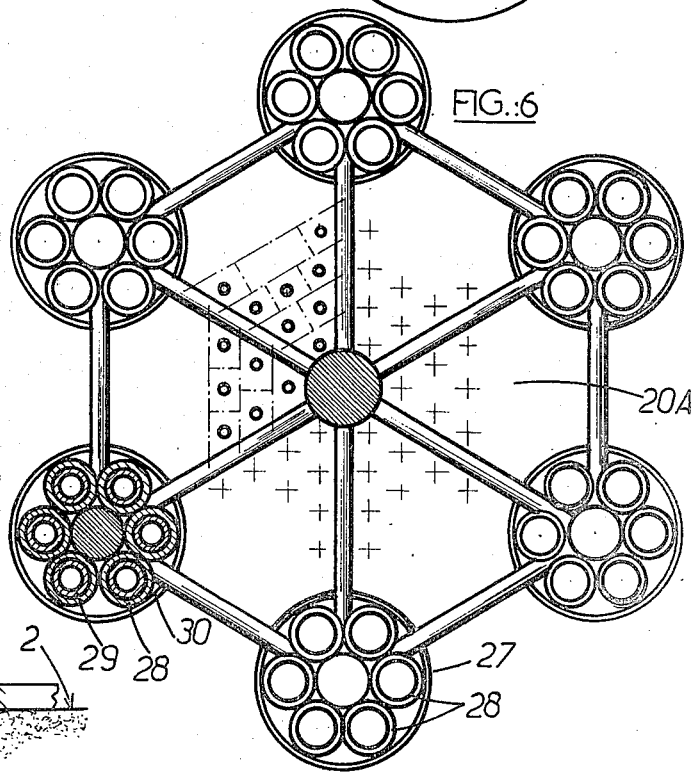

OSCILLATABLE MARINE INSTALLATION AND METHOD FOR ITS CONSTRUCTION

BACKGROUND OF THE INVENTION

1. Field of the Invention

This invention relates to an oscillatable marine installation and, in particular, a platform to be installed on a permanent site in the sea or other expanse of water which can have various uses, such as for storing materials or carrying drilling equipment.

The installation comprises a shaft resting on a base fixed to the sea bed, which supports on its upper part the so-called platform or bridge, the height of the shaft being sufficient for the bridge to be always above water-level.

The shaft is connected to the base by means of a spherical joint which enables it to oscillate in all directions as it is moved by the swell, and is ballasted near its base in such a way that the total weight of the ballast, shaft, bridge and the load carried in greater than the maximum upward thrust due to buoyancy and to the action of the elements, whereby the spherical joint is always compressed.

2. Description of the Prior Art

A similar construction is known from U.S. Pat. No. 4,126,010, in which the shaft comprises a watertight hollow column which can receive ballast at its lower end, while the upper part comprises a float. Such an invention is particularly suitable for an installation of relatively low height. However, the greater the height, the greater is the tendency for the shaft to respond to the swell. In order to avoid this disadvantage, elements of varying rigidity are positioned at intervals.

The float part of an installation with a cylindrical shaft is particularly vulnerable near the surface since there is the risk that it may be damaged by boats which are being moored. In spite of the float being divided into compartments, any leakage of water into a compartment causes the installation to list considerably, to a degree which cannot be accommodated by drilling pipes. The movements of the platform subject the drilling pipes, which are generally positioned on the periphery of the shaft, to bending stresses which increase with their distance from the axis of the shaft, and even more so if the distance separating the bottom of the shaft from the base is small.

U.S. Pat. No. 3,670,515 discloses a solution to this problem. It describes a rocking drilling platform comprising a shaft composed of a grid type of structure having a float on its upper part. The lower end of the shaft is connected to the base, which is held on the sea-bed by means of piles, by a joint. The drilling pipes pass downwardly along the shaft and then to the exterior thereof where they are guided by supports. In order to avoid too much bending of the pipes to one side of the joint, the latter is supplied with a support device in the plane of the joint, this device being connected to the shaft and to the base by articulated rods which enable the pipes to slide freely. Such an arrangement necessitates sufficient free lengths of pipe so that the loads can be distributed and so as to avoid exceeding the elastic limit of the metal.

SUMMARY OF THE INVENTION

The pivot joint of the oscillatable installation according to the invention differs from that described in the above-mentioned specification. It comprises, as is known from U.S. Pat. No. 4,126,010, two spherical segments separated by a pad or resilient assembly. The assembly is in the form of a part-spherical shell or elements making up a part-spherical shell and comprising a stack of elastomeric sheets frictionally engaged by interleaved thin steel sheets, the stack being disposed between two thicker steel sheets which are mounted respectively on the two parts connected by the joint.

Construction of such a joint is essentially an integral part of the construction of the whole installation and would require construction on site. Furthermore, the joint should be fixed to the shaft and to the base before the positioning of the installation on site. Maintenance is therefore very difficult and changing of the assembly difficult to contemplate.

One of the objects of this invention is to provide an oscillatable installation, the pivot joint of which can be positioned and changed without difficulty, even after the installation is positioned on site.

Another object of the invention is to provide new means for forming and maintaining the base of the installation, enabling the angle of bending of the pipes to be reduced while protecting them from impact and currents, as well as keeping the pipes at a constant tension no matter what movement the installation makes.

Another object of the invention is to limit the listing of the installation in the case of leakage of water into the float for any reason.

Finally, an object of the invention is also to avoid rotation of the installation around its axis. In fact, the sea currents and/or winds can impart a torque to the installation. If the torque is low, then the joint assembly will balance this torque by a compensating torque produced by the layers of elastomer. In the case of the two surfaces of the joint being free in relation to each other, there will no longer be any compensating force to counterbalance the rotation torque. The consequent rotation of the platform produces serious disadvantages, particularly when the platform forms part of a unit connected by bridges and foot-bridges. Serious disadvantages also arise when the torque causes loads which exceed the elastic limit of the assembly, thus causing it to shear, which puts the joint out of action.

Rotation of the installation around its axis will be avoided by providing an anti-torque device between the shaft and the base, comprising a universal joint.

BRIEF DESCRIPTION OF THE DRAWINGS

The following is a detailed description of embodiments of the invention, reference being made to the accompanying drawings in which:

FIG. 2 is a horizontal section along the line II—II of FIG. 1, FIG. 6 is a horizontal section along the line VI—VI of FIG. 1, FIG. 7 is a view of the means for holding the pipes.

DETAILED DESCRIPTION OF THE PREFERRED EMBODIMENTS

Figure 1:
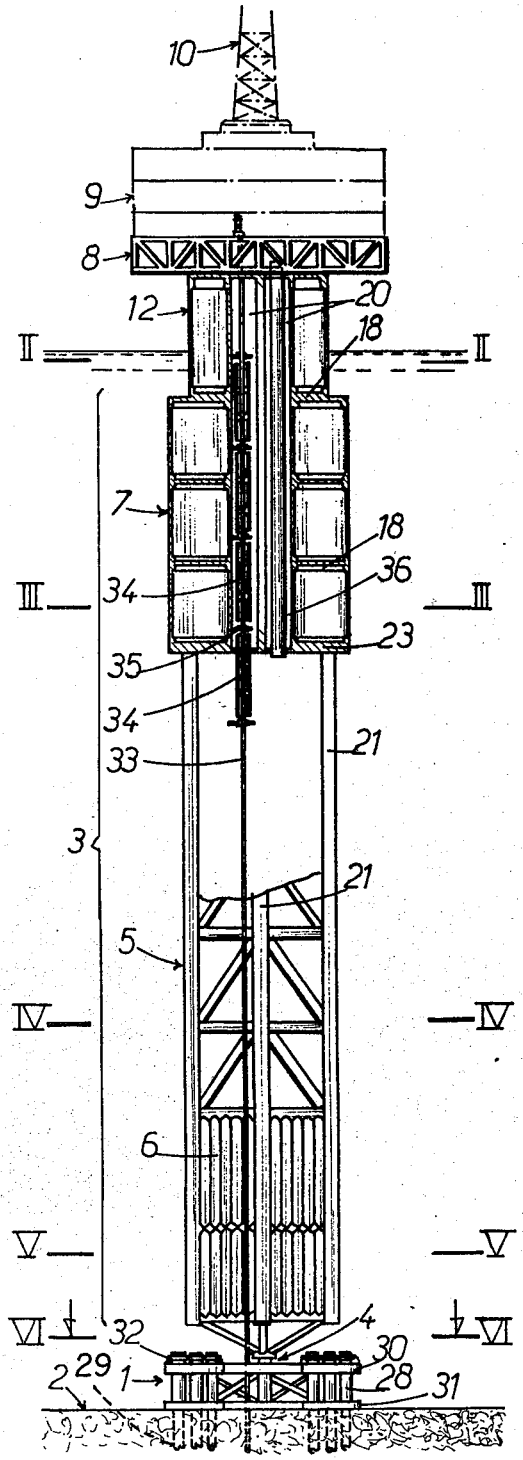
FIG. 1 is a part-sectional view of an installation according to the invention.

FIG. 1 is a part-sectional view of an oscillatable installation comprising a base 1 resting on the sea-bed 2. A shaft 3 is supported on this base by a part-spherical pivot joint 4. The shaft comprises a steel lattice structure 5, the lower part of which is provided to form a space 6 which can receive the ballast, the upper part forming the cellular structure 7 of the float. The top of the shaft supports the bridge 8 on which are mounted working and living modules 9 and the drilling derrick 10. According to the embodiment illustrated in FIG. 1, the shaft 3 has a reduced diameter at its upper section 12, part of which is immersed, so as to reduce the effect of surface currents. As shown in FIG. 2, cellular structure 7 comprises in its upper section 12 spaces enclosed by water-tight elements 13 which are at least partly cylindrical. These water-tight elements 13 each have one of their walls defined by exterior cylindrical surface 14 of the upper section 12. Cylindrical surface portions 15 are distributed at regular intervals inside this exterior cylindrical surface 14. These cylindrical surface portion 15 extend along the height of cellular structure of the float and are extended to form wholly cylindrical enclosures 16 below the upper section 12. The exterior cylindrical wall surface 14 rests on the cylindrical enclosures 16 which are disposed side-by-side, for example, around a circumference, so as to form a geometrically closed figure.

Figure 3:
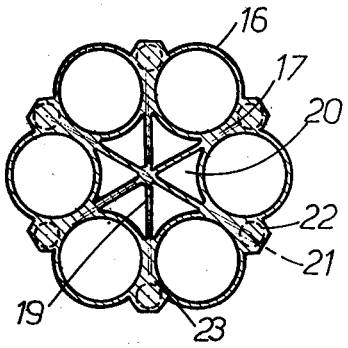
FIG. 3 is a horizontal section along the line III—III of FIG. 1.
Figure 4:
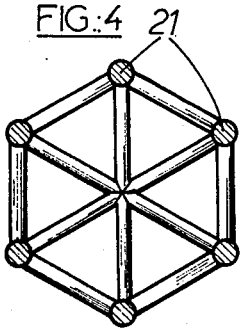
FIG. 4 is a horizontal section along the line IV—IV of FIG. 1.

The cellular structure 7 of the float is prefereably made of concrete using, for example, the technique of sliding shuttering. The cylindrical enclosures 16 are joined together by tangential connecting portions 17 and are separated by water-tight partitions 18, shown in FIG. 1, perpendicular to their axis. Rigidity of the structure is provided by radial partitions 19, shown in FIGS. 2 and 3, which divide the interior space 20 in the longitudinal direction and are supported on the tangential connecting portions 17. FIG. 3, which is a horizontal section along line III—III of FIG. 1 of the cellular structure 7 of the float, shows the means for attaching the columns 21 of the steel lattice structure 5 to the concrete cellular structure 7 of the float. Sockets 22 are provided at the bottom 23 of the float to receive and hold the upper ends of the columns 21. According to the embodiment illustrated in FIG. 4, the steel lattice structure 5 comprises six columns 21 which are cross-braced with each other diametrically.

Figure 5:
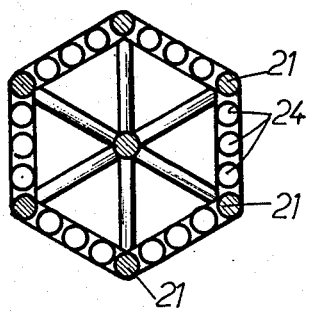
FIG. 5 is a horizontal section along the line V—V of FIG. 1.

As shown in FIGS. 1 and 5 lower space 6, which can take solid or liquid ballast, comprises sections of pipes 24 placed side-by-side along the sides of the hexagon formed by the six columns 21. This structure is preferably of metal, but can also be formed by concrete pipes. A cellular structure can also be used as a float during the positioning of the shaft 3. This use will be described later on.

The shaft 3, as already described, rests through the pivot joint 4 on a weighted base 1. Instead of ballast spce 6 and base 1, another embodiment, diagrammatically shown in FIG. 19, comprises a partitioned base body 25 receiving the ballast, at the center of which is fixed a part housing 26 of the pivot joint 4. Such a base is preferably retained on a sea-bed 2 having good cohesion and having a sufficiently thin layer of mud. If the installation has to be set up on particularly unstable ground with a considerable thickness of mud, a lattice type of base 1, as shown in FIG. 1, is used which can be fixed into the sea-bed 2 by means of piles 29, the length of which can be adjusted. Using the conventional technique, the base 1 is held down by a relatively small number of piles 29 owing to the limited dimensions of the base 1, and its use in ground with a large thickness of mud is rather risky. According to one embodiment of the invention shown in FIG. 6, barrels 27 have been placed on the periphery of base 1. These barrels 27 are distributed at regular intervals, according to the embodiment, on the apices of the base 1 and comprise groups of vertical pipes 28 which can hold the piles 29. The pipes 28 are fixed into bores provided in two discs 30 and 31, spaced apart and welded to the lattice structure of the base 1 (FIGS. 1 and 7). According to a known method, the piles 29 are driven into the pipes 28 and their ends are joined at top 32. So as to avoid too high loads on drilling pipes 33, owing to oscillating movements of the installation, the drilling pipes 33 can be passed through the interior space 20 (see FIG. 2), through the lattice structure 5 of the shaft 3 and into the free inner space 20A of the base 1. The pipes 33 are close to the axis of the platform and the deflections are very much reduced at the level of the pivot joint 4 (FIGS. 1, 2, 6).

FIG. 2 shows the distribution possible drilling of the pipes 33 in the cells formed by the radial partitions 19 in the space interior 20. In order to avoid the pipes 33 being distorted they should be supported and, to compensate for their weight, the usual technique consists of applying tension to their ends by means of bellows of adjustable length, such as are described, for example, in U.S. Pat. No. 3,677,016. This device necessitates the use of rather complicated equipment, so that, if the drilling pipes 33 are on the side where the bridge 8 is sloping down, they are not subjected to unduly high compression and so that, if those drilling pipes 33 are on the opposite side, they are not stretched out too much. This embodiment of the present invention incorporates a new method consisting of the use of buoyancy to transmit the necessary tension to the pipes 33. According to an embodiment of the invention shown in FIGS. 1 and 7, annular floats 34 are fixed on the drilling pipe 33 and at least on the transverse part of the cellular structure 7 of the float. Guide means 36 are provided so that the pipe 33 can move freely in the longitudinal direction. These annular floats 34 may comprise, for example, as shown in FIG. 1, collars 35 integral with the shaft 3, in which the drilling pipes 33 slide, and which are preferably used when the inner space 20 is in communication with the exterior space of the cellular structure 7. Such communication is provided, for example, by piercing the bottom wall 23 defining the interior space 20 of the cellular structure 7. The passages formed in this way are sufficiently large to enable the drilling pipe 33 to pass through freely, and possibly also the annular floats 34. According to another embodiment of the guiding means, they are composed of shafts 36, which partly occupy the free interior space 20, provided during the construction of the cellular structure 7 of the float. The shafts 36 alone are in communication with the water, and their diameter is sufficient to allow the annular floats 34 to move freely in the longitudinal direction, as shown in FIG. 7. Owing to the high reliability of the device for tensioning the drilling pipes 23, the heads 37 of the drilling pipes 23 are placed on the bridge 8 (these being free to move in relation to the bridge 8), which greatly facilitates maintenance operations on the whole unit.

Figure 8:
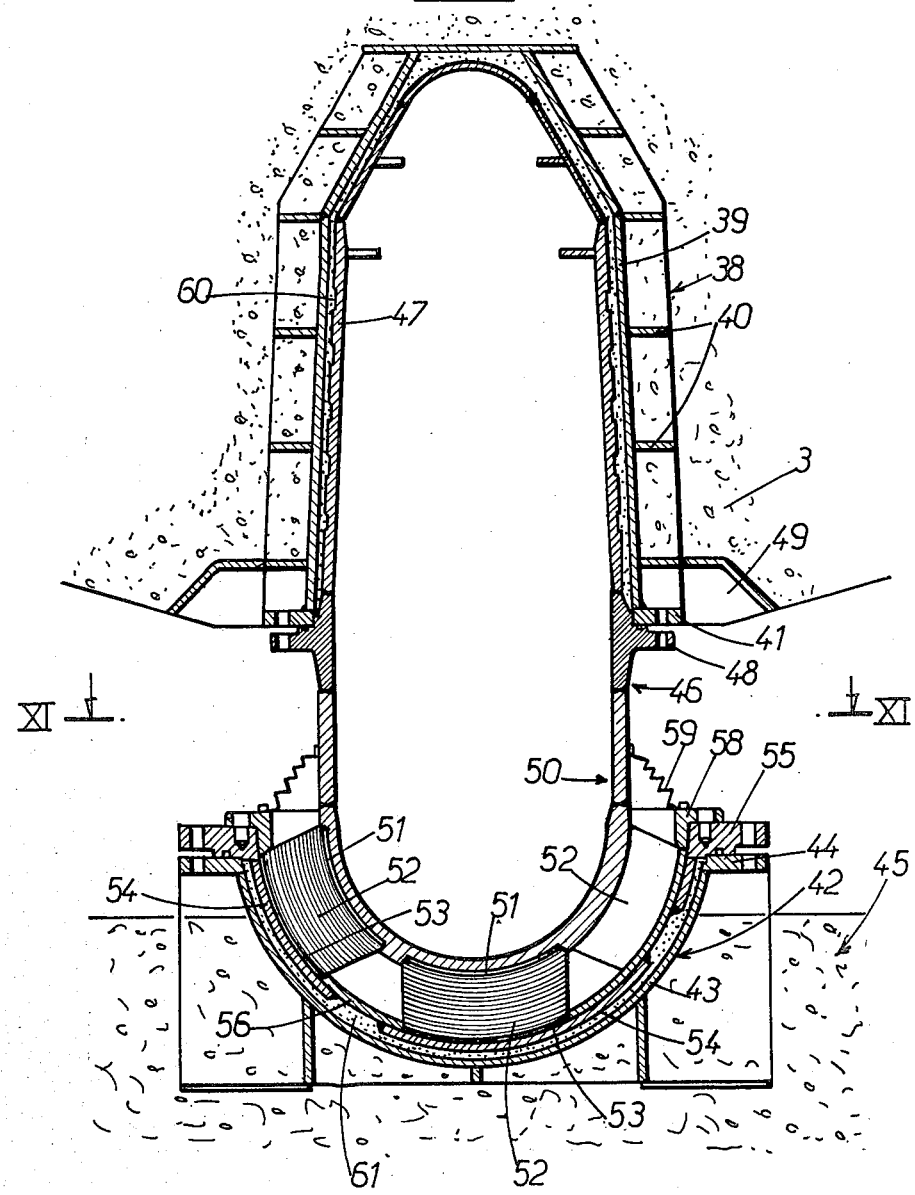
FIG. 8 is a sectional view of one form of removable pivot joint.

As shown in FIG. 8, part-spherical pivot joint 4 comprises a resilient assembly 52 composed of a stack of alternate layers of elastomer and sheet metal, inserted between two metal supports 51 and 53. The pivot joint 4 should last for around 30 years, but if it is desired to extend this length of wearing life or to dismantle the installation, a process has been provided to remove and also to replace the pivot joint 4. According to one embodiment of the invention, the pivot joint 4 is made demountable. FIG. 8 is a vertical section through an embodiment of a demountable pivot joint 4. This is composed of at least three parts: a first part 38 integral with the shaft 3, comprising a metal casing 39, which is at least partly conical and is fixed by outer ribs 40 to the concrete base of the shaft 3 or welded to the end of the lattice structure 5, and which has a flange 41 around its lower periphery; a second part 42 comprising a part-spherical housing 43 having a flange 44 around its upper periphery and which is fixed on a base 45 formed of concrete or comprising a steel lattice; and a third part comprising a pivot member 46 cooperating directly or indirectly with the first part 38 and second part 38. The pivot member 46 has a conical upper part 47 of a shape which approximately complements that of the casing 39 in which it rests. The conical upper part 47 has at its lower end a flange 48 which is secured to the flange 41 by means of bolts (not shown). In the case of a concrete shaft 3, so as to allow access to the back of the flanges 41, a bowl 49 is provided. The lower portion 50 of the pivot member 46 is of a cylindrospherical shape, on which the first metal supports 51 of the portions alternate layers 52 of the resilient assembly are mounted. The second metal supports 53 are mounted on a bush 54 of a smaller radius than that of the part-spherical housing 43 fixed to the base 45. Around the upper peripheral edge of the bush 54 there is a flange 55 which can be fixed by known means on to the flange 44 on the housing 43.

Figure 9:
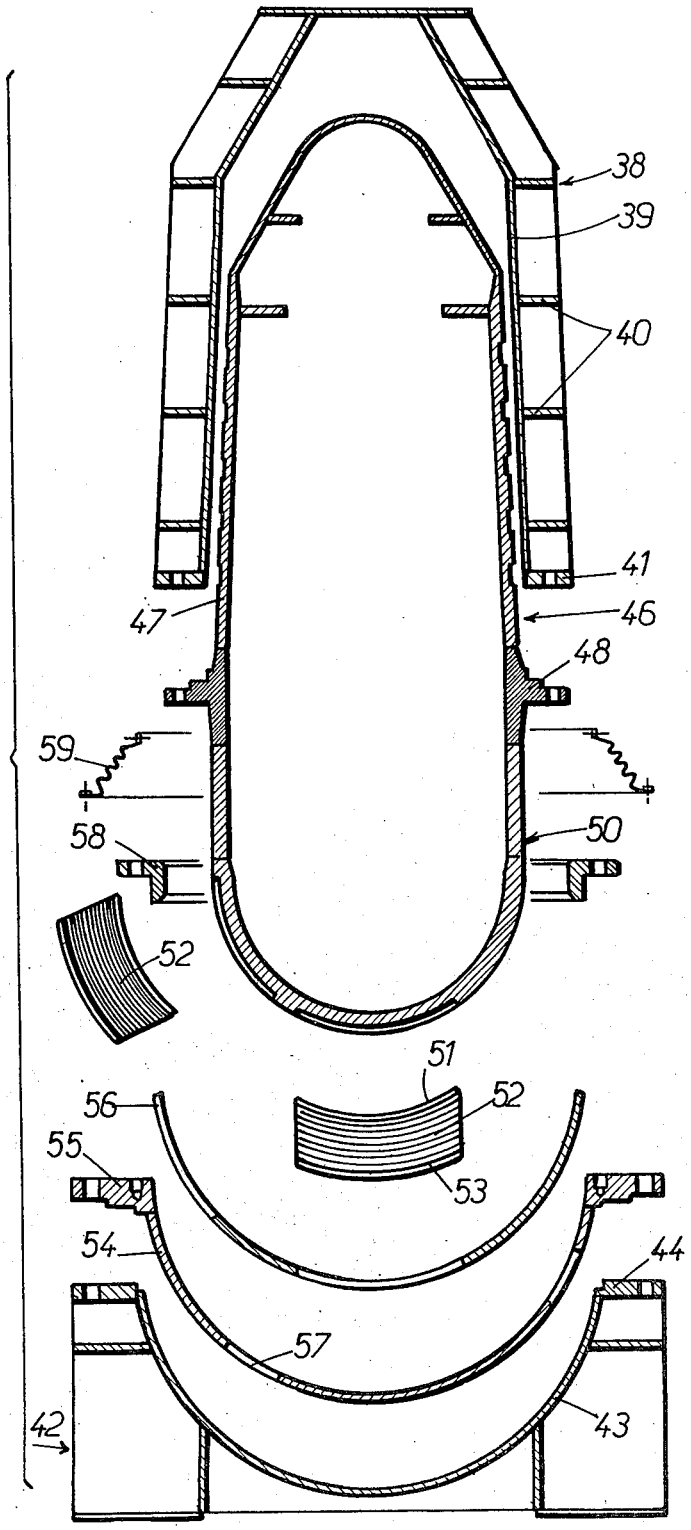
FIG. 9 is an exploded sectional view of the pivot joint of FIG. 8.

According to the embodiment shown in FIGS. 8 and 9, the second metal supports 53 of the alternate layers 52 of the resilient assembly are held in a second housing 56. This second housing 54 is welded to the bush 54 through apertures 57 provided in the latter as shown in FIG. 9. The edges of the second housing 56, which are not welded, are clamped by a ring 58 which is secured to the flange 55 of the bush 54. In order to protect the pivot joint 4, and in particular the resilient assembly, an impervious flexible annular cover 59 is provided between the lower portion 50 and the ring 58. The alternate layers 52 of the resilient assembly are of prismatic or cylindrical peripheral shape and end in two part-spherical segments, one convex and the other concave.

The spaces 60 and 61, formed respectively between the casing 39 and the upper part 47 of the pivot part member 46 and between the spherical housing 43 and the bush 54, are injected with a filling of cement, which simplifies and facilitates the production of concentric elements and the transmission of force between the various elements. However, this pivot joint 4 can be taken apart to enable the elements to be separated if desired.

Figure 10:
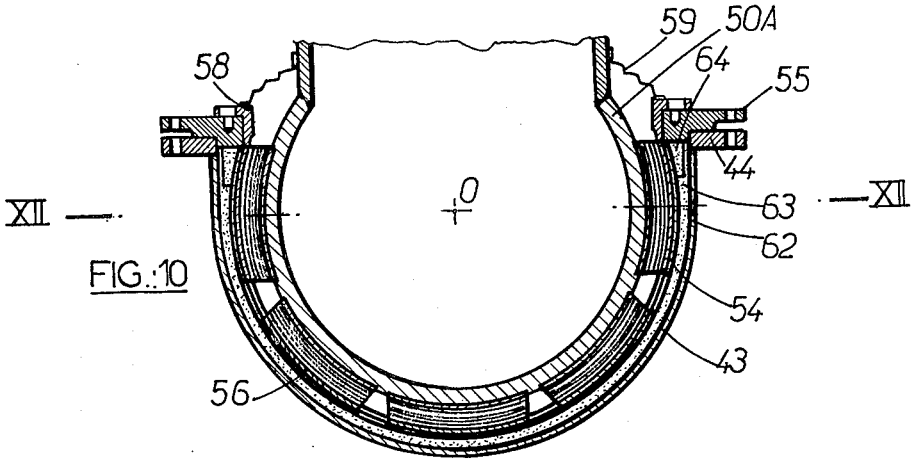
FIG. 10 is a sectional view of another form of removable pivot joint.

Another embodiment of a collapsible pivot joint 4 is shown in FIG. 10. The elements similar to those in the previous embodiment are given the same reference numerals. The lower portion 50A holding the portions of the resilient assembly is part-spherical, its center O being within the pivot joint 4. The edge of the hemispherical housing 43 is extended by a cylindrical extension 62 on which the flange 44 is mounted. The bush 54 follows the spherical curve above the center O, and leaves a space 63 forming a wedge-shaped section between it and the cylindrical extension 62 of the housing 43. This space 63 is partly taken up by a ring 64 fixed to the outer edge of the bush 43.

In the examples previously given of a demountable pivot joint 4, the resilient assembly is in the form of separate portions which together make up the assembly. This form of assembly has the advantage of allowing more efficient cooling which is necessary when the weight being oscillated is considerable. According to one embodiment, the resilient assembly (FIG. 11) is made up of lateral polyhedral part-spherical segments 65 which are arranged between the concave surface of the housing 43, starting at the edges of the housing 43 and extending towards the bottom, and the outer surface of a central pentagonal part-spherical segment 66 placed at the bottom.

Figure 12:
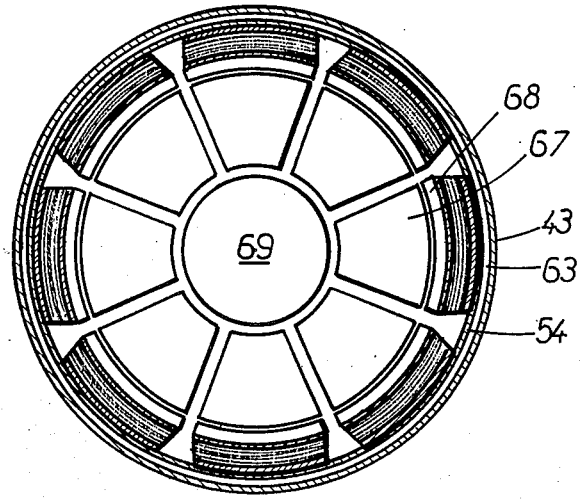
FIG. 12 is a view of another embodiment of an assembly along the line XII—XII of FIG. 10, FIGS. 13 to 18 illustrate the various stages of dismantling a pivot joint according to the invention.

According to another embodiment shown in FIG. 12, which is a view taken along line XII—XII of FIG. 10 after having removed the lower portion 50A, the assembly comprises lateral portions of part-spherical sectors 67, 68 arranged between the inner concave surface of the housing 43 starting at the edges of the 43 housing and extending towards the bottom, and the outer convex surface of a central circular part-spherical segment 69 placed at the bottom.

Figure 11:
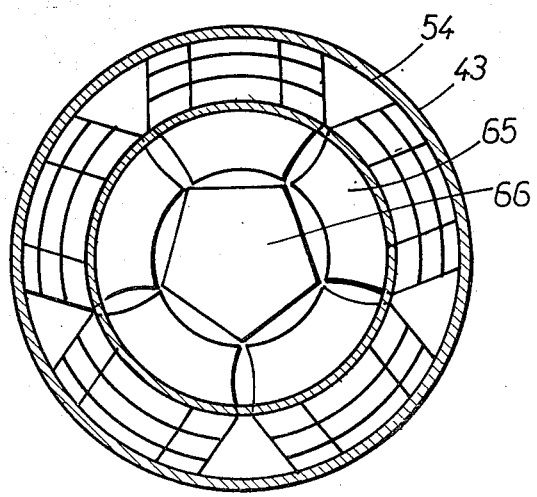
FIG. 11 is a view of an assembly along the line XI—XI of FIG. 8.

The pivot joint 4 illustrated in FIG. 8 is provided with an assembly of a type corresponding to that described with regard to FIG. 11, which is a view taken along line XI—XI of FIG. 8 (the pivot member 46 not being shown), and that of FIG. 10 is of the type described with regard to FIG. 12 which is a view taken along the line XII—XII of FIG. 10.

The two different processes of dismantling and reconstructing the pivot joint 4 in an installation according to the invention are shown in FIGS. 13 to 18 and 19 to 22, respectively.

Figure 13:
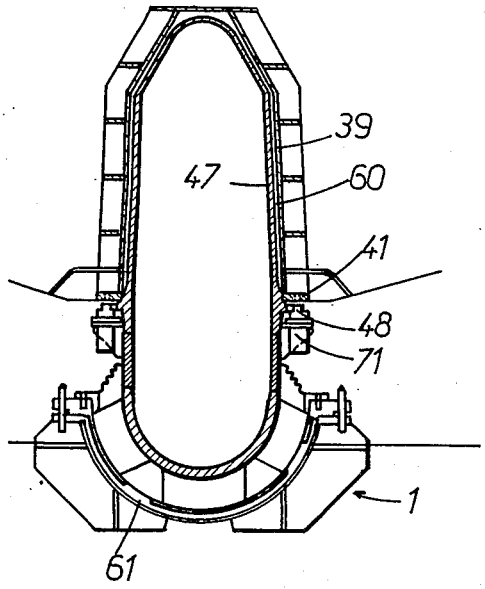
Figure 14:
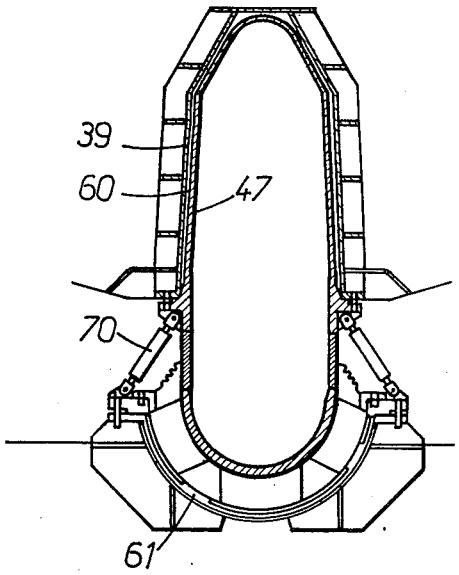
Figure 17:
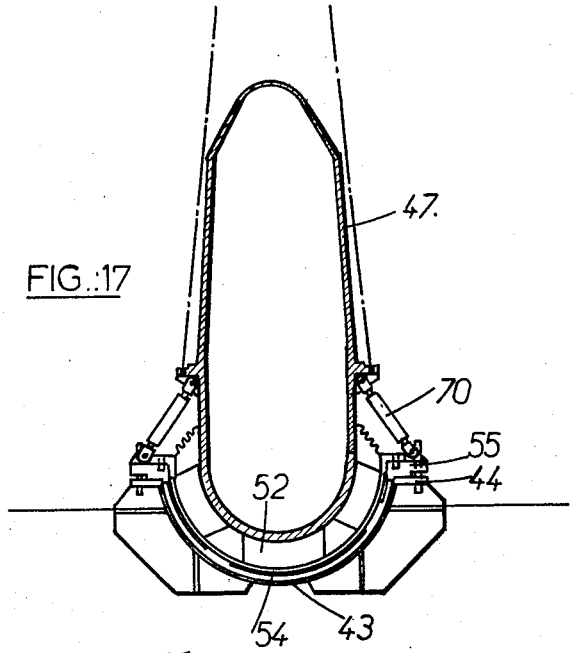
Figure 18:
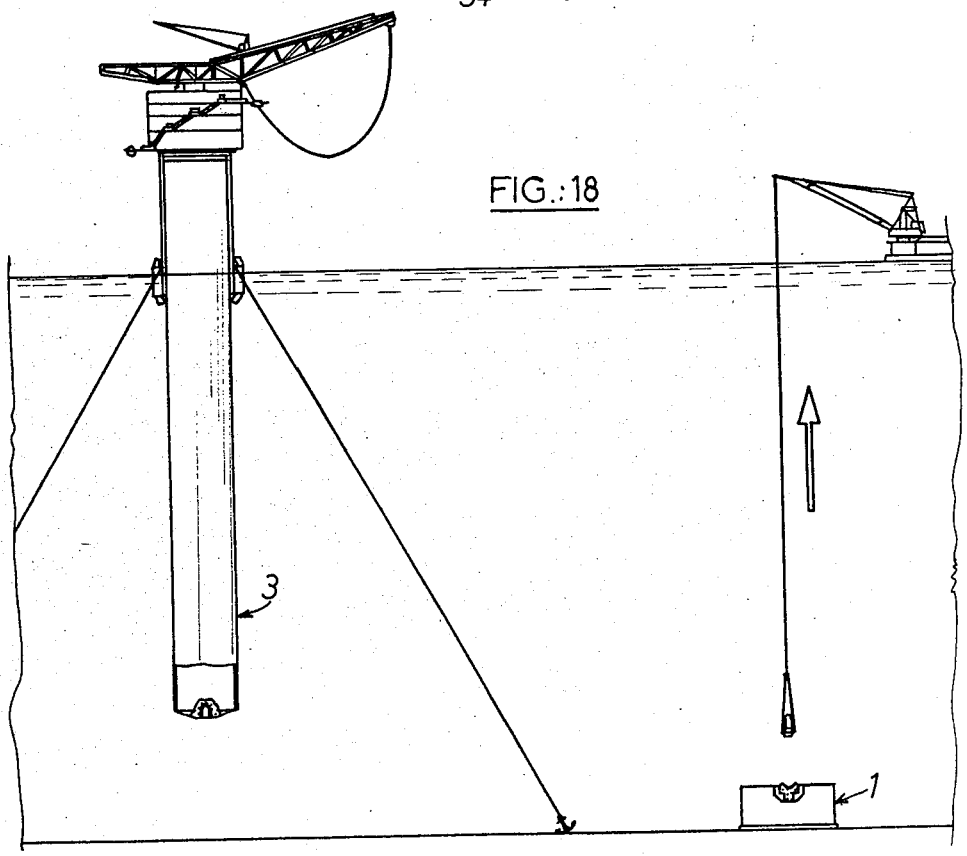

Before dismantling the pivot joint 4, the wells for oil production are stopped and the section of the drilling pipes 33 in FIG. 7 between the head 37 of the shaft 3 and the sea-bed 2 is dismantled. Then one can proceed with dismantling the pivot joint 4 by carrying out the following operations: the connection between the upper part 47 of the pivot member 46 and the casing 39 is removed. To do this, the bolts attaching the flange 48 of the upper part 47 to the flange 41 of the casing 39 are withdrawn (FIG. 13). The upper part 47 is separated from the casing 39 (FIG. 15) by lightening the shaft 3, which is done by removing the ballast from the floats 6 and 7 shown in FIG. 1. The upper part 47 is completely released from the casing 39 (FIG. 16) and the shaft 3 is moved upwardly and then laterally. The upper part 47 is attached to lifting means, and the connection between the flange 55 of the bush 54 and the flange 44 of the housing 43 fixed on the base 1 is removed (FIG. 17). The upper part 47 and its assembly is hoisted up. FIG. 18 illustrates the latter operation and shows the respective positions of the platform and the base 1.

The force which has to be exerted to disengage the upper part 47 from the casing 39 and, in particular, to overcome the frictional resistance between the cement joint in the space 60 (FIGS. 13–15) and the wall of the metal casing 39, which is coated during assembly with a release agent, means that there is a risk of causing the tearing out of the resilient assembly. In order to avoid this disadvantage, bracing links (FIGS. 14–17) 70 are arranged between the flange 48 (FIG. 13) of the upper part 47 and the flange 55 of the bush 54 (FIG. 17), and these bracing links 70 transmit the force to the bush 54 without any risk to the resilient assembly.

Figure 15:
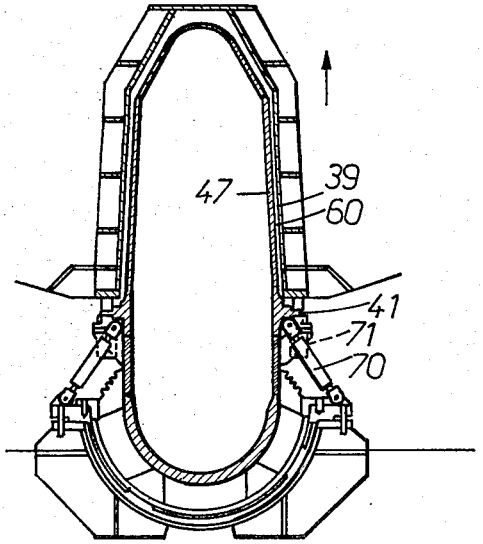
Figure 16:
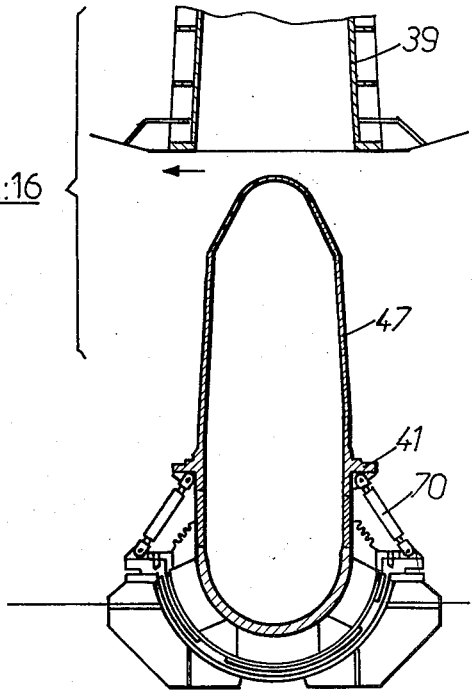

Detaching the upper part 47 from the casing 39 solely by removing the ballast from the shaft 3 is a delicate operation which is difficult to control. So as to control this operation perfectly, the process is modified in the following way. Thrust means 71 (FIG. 13), such as jacks, are located between the upper part 47 and the casing 39 and, in particular, between the flange 48 of the upper part 47 and the flange 41 of the casing 39. The jacks 71 are arranged between the bracing links 70 (FIG. 15). The connection between the flange 48 and the flange 41 is removed (FIG. 15), if this operation has not already been carried out. The jacks 71 are actuated in such a way that the total force produced by the jacks 71 is greater than the assumed initial resistance, and the shaft 3 is lightened (FIG. 15) until the cement joint occupying the space 60 is broken. At this moment the shaft 3 is no longer floating but still rests on the pivot joint upper part 47. The breakage of the cement joint in space 60 is indicated by the drop in pressure in the jacks 71. The remainder of the operation is carried out in the manner previously described.

Figure 19:
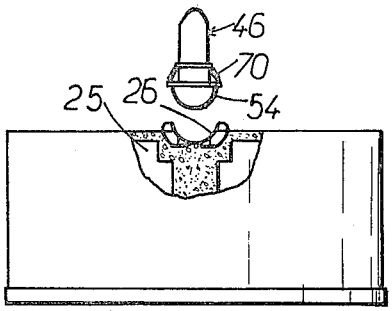
FIGS. 19 to 22 illustrate the various stages of reassembling a pivot joint.
Figure 20:
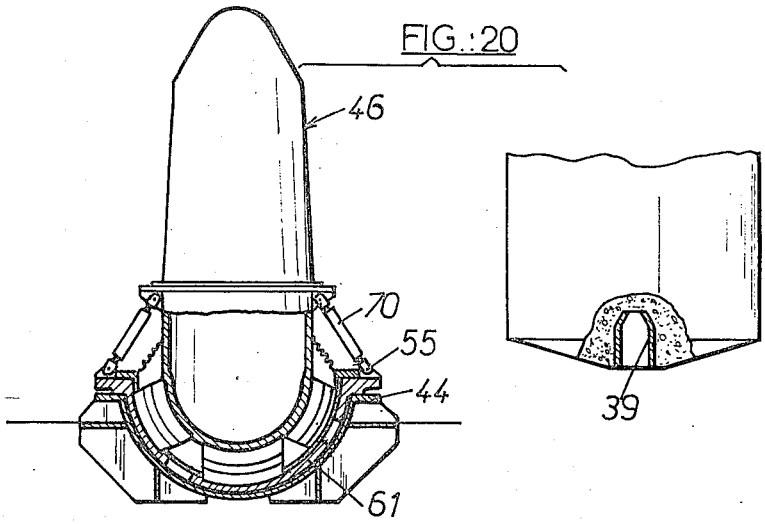
Figure 21:
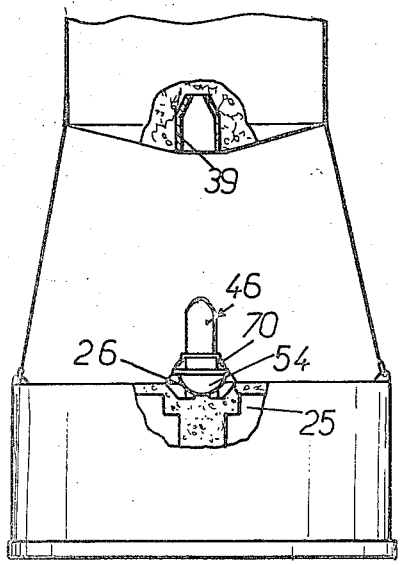
Figure 22:
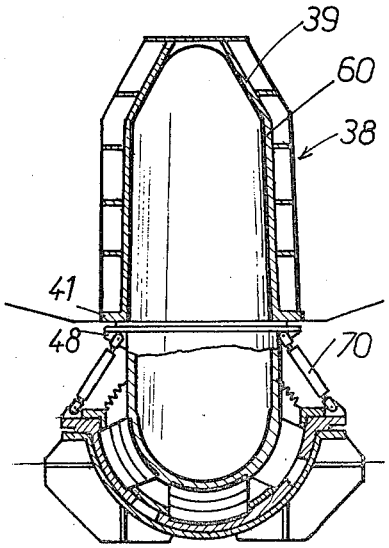

To reassemble a new joint, the process is followed which is shown diagrammatically in FIGS. 19 to 22. Similar elements to those previously described are given the same reference numerals. The new pivot member 46, fitted with bracing links 70, is suspended by lifting means, lowered and put in position so that the bush 54 is located in the housing part 26 fixed to the partitioned base body 25 (FIG. 19). As shown in FIGS. 19 and 20, flange 55 of the bush 54 is fixed on to the flange 44 of the housing part 26, the lifting means are disconnected and a flow of cement is injected into the space 61 between the bush 54 and the housing part 26 through injection points which are not shown (FIG. 20). The shaft 3 bearing the metal casing 39 is positioned above the pivot member 46 (FIG. 21). The shaft 3 is ballasted in such a way that the casing 39 covers the pivot member 46 (FIG. 22). The flange 48 of the pivot member 46 is fixed to the flange 41 of the casing 39 and a flow of cement is injected between the first part 38 of the pivot member 46 and the casing 39 in the space 60 (FIG. 22). The bracing links 70 are then dismantled.

The method for constructing and positioning the oscillatable installation according to a preferred emnbodiment of the invention shown in FIG. 1 comprises the following operations: the base or bottom 23 of the cellular structure 7 of the float is constructed on land or in a floating dock, this structure being assembled to a sufficient height to ensure that it is floatable. Simultaneously, the steel lattice structure 5 of the shaft 3 and the base 1 are constructed on site.

Figure 23:
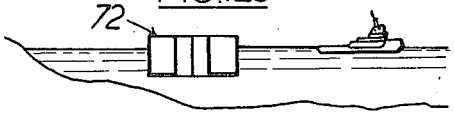
FIGS. 23 to 30 show the phases of construction and positioning of an installation with a removable pivot joint and a lattice type of base.
Figure 24:
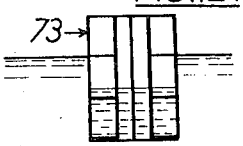
Figure 25:
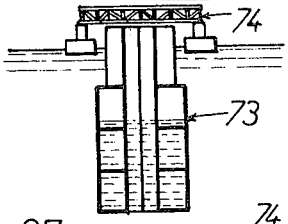
Figure 26A:
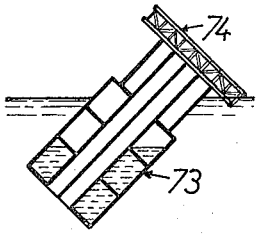
Figure 26B:
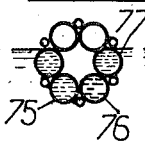
Figure 27:
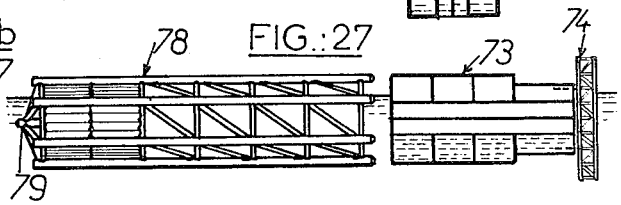
Figure 28:
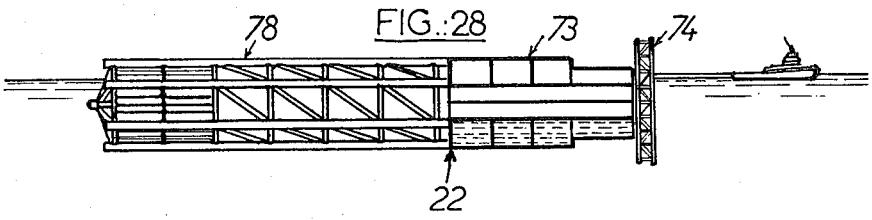
Figure 29:
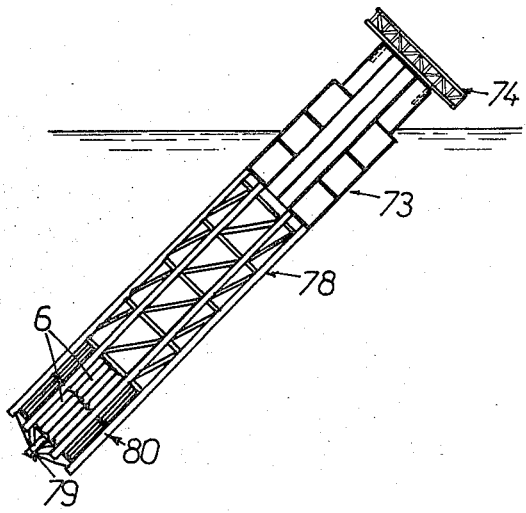
Figure 30:
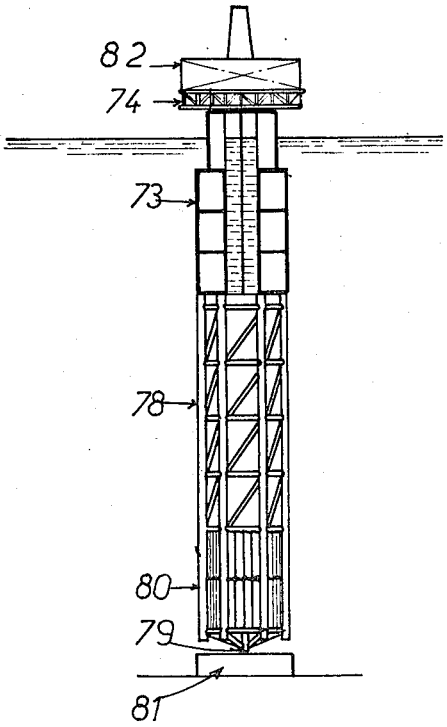

The base 72 of the float 73 is then launched (FIG. 23) and the cellular structure of the float 73 is completed afloat by, for example, the method of sliding shuttering (FIG. 24). The bridge 74 is placed on the float 73 according to the known method of ballasting the float 73 (FIG. 25). The cells 75 to 77 of the float 73 are ballasted (FIG. **26*a*) so as to lay the whole of the float 73 and bridge 74 down horizontally at the water surface (FIG. 26*b*). The lattice structure 78, the end of which bears the pivot member 79, is also put in a horizontal position (FIG. 27). The float 73 and the lattice structure 78 are assembled by means of the sockets 22 (see FIG. 3), and the whole unit is towed to the site (FIG. 28). The spaces 6 in the lower part 80 of the lattice structure 78 are ballasted so as to get the platform into the vertical position (FIG. 29). The platform is placed above the base 81 which has previously been positioned, and the pivot member 79 is lowered into position, that is, as shown in FIG. 19, the bus 54 is placed in the housing part 26 fixed to the base body 25. They are then secured, as shown in FIGS. 20 and 21, which securement involves bolting the flange 44 of the bush 54 to the flange 55 of the housing part 26 and injecting a flow of cement into space 61 between them. The bracing links 70 are then dismantled, and the modules 82 are installed on the bridge 74 (FIG. 30**).

This method is particularly suitable for an installation as shown in FIG. 1 with a steel lattice type of base 1, as this base 1 needs to be previously fixed to the bed by piles 29.

If a weighted base 1 is used, one can proceed in the same manner. However, with the demountable joint shown in FIGS. 13–22, it is possible to use the method which is hereinafter described and which has the advantage that the float does not need to be laid down and high capacity crane barges are not required as shown in FIG. 18.

As shown in the method of FIGS. 31–34, the cellular structure of the float 73, the base 83, and the steel lattice structure 78 are constructed simultaneously on land.

Figure 31:
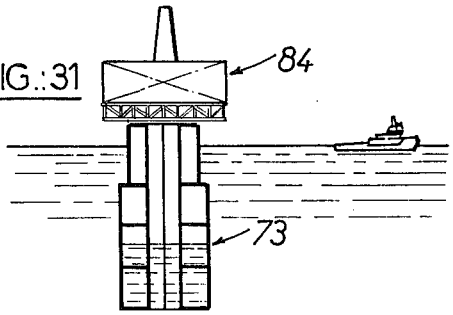
FIGS. 31 to 34 show the final phases of construction and positioning of an installation with a ballasted base.
Figure 32:
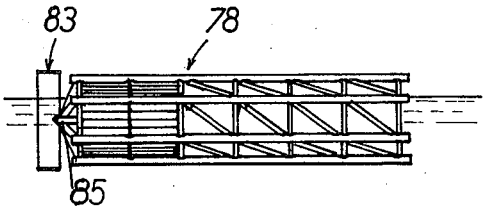
Figure 33:
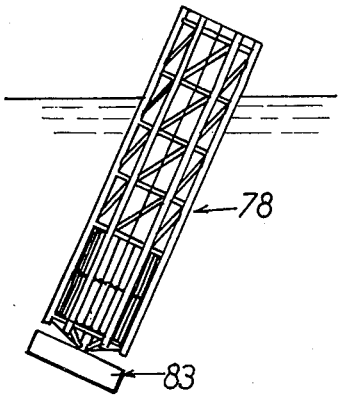
Figure 34:
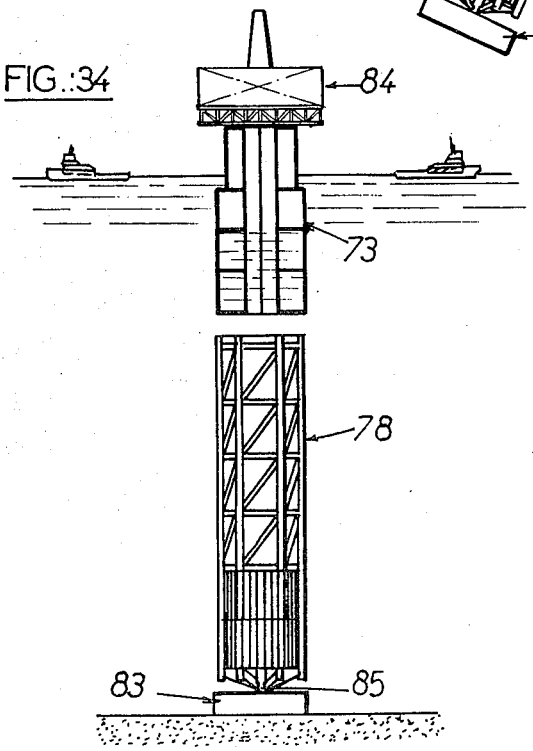

The construction of the weighted base 83 is similar to that of the cellular structure of the float 73. The bottoms of the float 73 and of the base 83 are launched, the latter being completed afloat. The bridge 84 comprising the modules and the derrick is positioned on the cellular structure of the float 73 and it is towed to the site (FIG. 31). The steel lattice structure 78, on which the base 83 is fixed by means of the joint 85 and bracing links (not shown), is set afloat and towed to the site (FIG. 32). As the weighted base 83 comprises floats, its positioning at the end of the steel lattice structure 78 can be similar to the technique used to assemble the float on the cellular structure 73 in the previous method (FIGS. 27 and 28). The pivot member 85, held by the bracing links (not shown), comes to rest in the casing held by the shaft base 83. The same operations of fixing and forming a joint by the injection of cement, as described in the previous method, are carried out. The lattice structure 78 and the base 83 are ballasted so as to bring them into a vertical position on the site (FIG. 33). The cellular structure of the float 73 bearing the bridge 84 is placed above the structure 78 and is ballasted so that it rests on the columns of the cellular structure of the float 73, and it is fixed on to these columns (FIG. 34).

Figure 35:
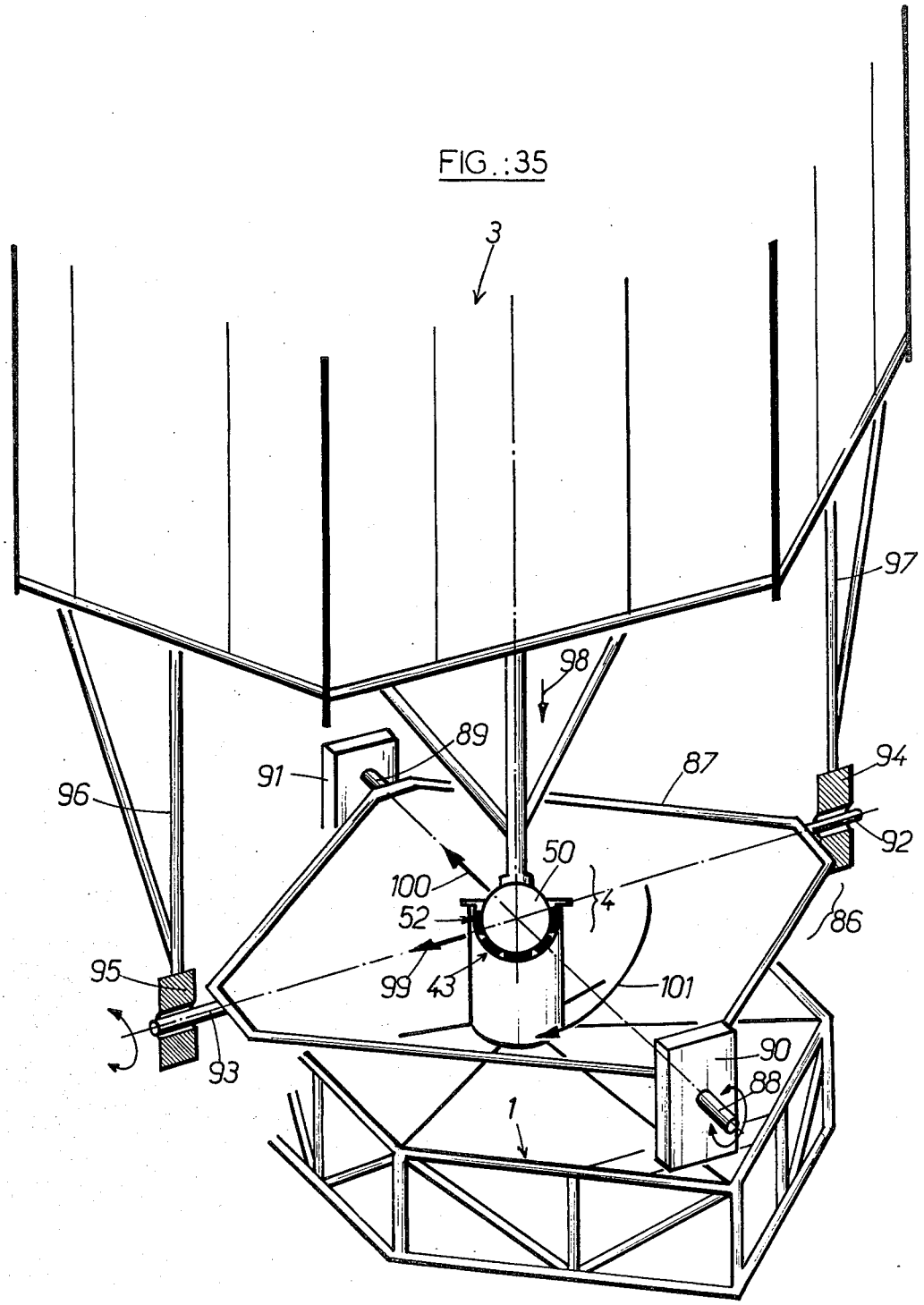
FIG. 35 is a diagrammatic perspective view of an anti-torque device provided in the installation according to the invention.

FIG. 35 shows a partial diagrammatic view of the lower part of an installation. The shaft 3 rests on the base 1 by means of the spherical pivot joint 4. The convex spherical portion 50 of the pivot joint 4 is fixed to the lower part of the shaft 3 and rests directly or indirectly, via a pad or resilient assembly 52, in the concave spherical housing 43 fixed to the base 1. The anti-torque device 86, arranged between the base of the shaft 3 and the top surface of the base 1, is made up of a universal joint (88-95) concentric with the pivot joint 4.

According to the embodiment shown diagrammatically, a frame 87, preferably square, hereinafter referred to as a cross-piece, supports at each corner a pivot, the axes of rotation of the pivots being in line with the diagonals or two orthogonal axes. In this example, it will be seen that each pivot is made up of two elements: a bearing (90, 91, 94 or 95) and a trunnion, the cross-piece bearing the trunnions (88, 89, 92, 93) and the shaft 3 with the base 1 respectively supporting the bearings (90, 91, 94, 95). Thus, the opposite trunnions arranged along the same diagonal, for example, trunnions 88 and 89, cooperate with the bearings 90 and 91 supported by the base 1, and the trunnions 92 and 93 cooperate with the bearings 94 and 95 supported by the shaft 3 and, in particular, by the end of the arms 96 and 97. According to one embodiment, the trunnions 88 and 89 operate in conjunction with the bearings 90 and 91 via a damping device (not shown), this damping device being fixed on the one hand to the bearing (90 or 91) and on the other hand to the trunnion (88 or 89). Its distortion under torque should be sufficiently great to permit rotation of the trunnions 88 and 89 in relation to the bearings 90 and 91 without any friction or relative sliding being produced. Similar damping devices can also be provided between the trunnions 92, 93 and the corresponding bearings 94, 95.

The pivots of the anti-torque device 86 do not sustain vertical and horizontal loads, directed along the arrows 98, 99 and 100, these loads being totally taken up by the central spherical pivot joint 4, but they take up the torsional stress, indicated by the arrow 101, and transmit it to the base 1. The structure of the cross-piece 87 should therefore by rigid in relation to the couples being exerted in its plane. On the other hand, it has a flexibility or elasticity in relation to the perpendicular forces 98 on its plane and the forces 99, 100 being exerted in its plane, which is much greater than those of the pivot joint 4. This flexibility of the cross-piece 87 and the universal joints (88-95) causes the vertical and horizontal forces to pass through the central spherical pivot joint 4. On the other hand, the rigidity of the universal joint (88-95) under torque, being much greater than that of the spherical pivot joint 4, causes the torque to be directly transmitted to the base 1 by the universal joint (88-95).

Figure 36:
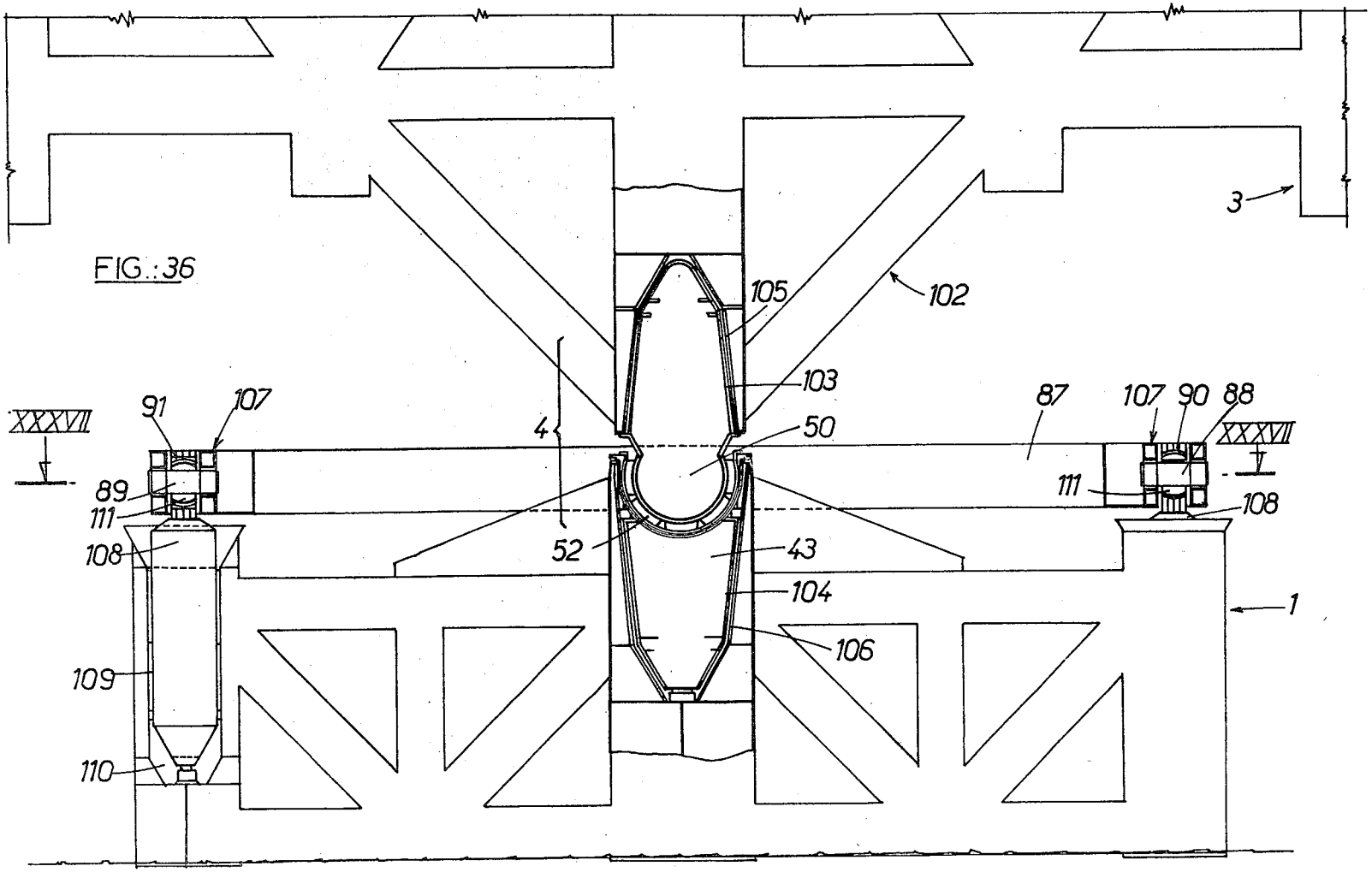
FIG. 36 is a part-sectional view (along line XXXVI—XXXVI of FIG. 37) of an embodiment of the invention.
Figure 37:
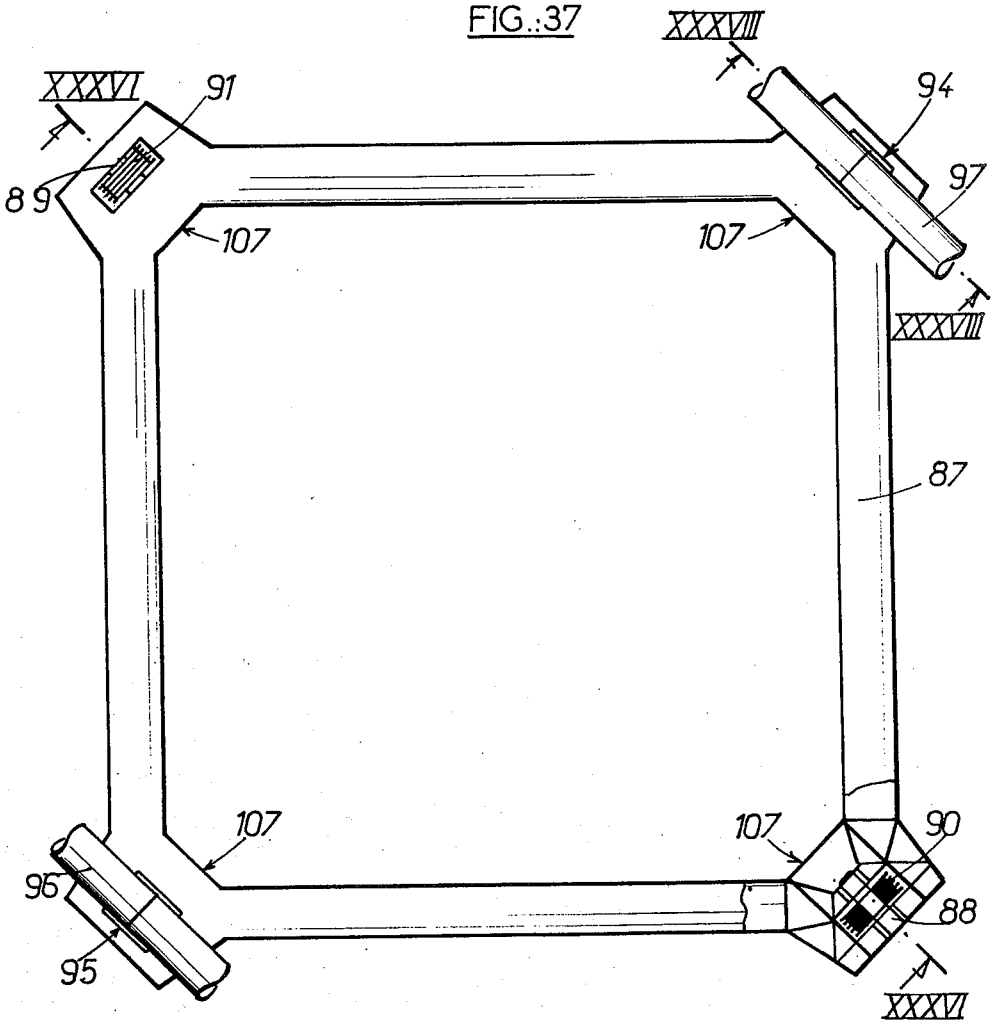
FIG. 37 is a partial reduced view from above, along line XXXVII—XXXVII of FIG. 36.
Figure 38:
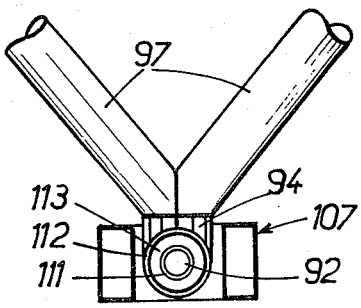
FIG. 38 is an enlarged, detailed view along line XXXVIII—XXXVIII of FIG. 37.

FIGS. 36, 37 and 38 show an embodiment of an installation comprising an anti-torque device 86. Similar elements to those in FIG. 35 are given the same reference numerals.

The shaft 3 comprises a lattice type of structure, the lower end of which comprises cross-bracing 102 which supports, on the axis of the shaft 3, a spherical portion 50 of the spherical joint 4. This spherical portion 50 works in conjunction with the second part 43 fixed into the base 1. The pivot joint illustrated is of the demountable type previously described. The spherical portion 50 of the pivot joint 4 is separated from the second part 43 by a resilient assembly 52 composed of separate alternate layers shown in FIGS. 8 and 9. Each of the parts of pivot point 4 is extended by a conical body 103 or 104, cooperating respectively with a casing 105 or 106 of an appropriate type. The casings 105 and 106 are fixed respectively to the structure of the shaft 3 and of the base 1.

As shown in FIG. 35, cross-piece 87 comprises a square, tubular frame, supporting at each corner a cage 107 keeping the trunnions 88, 89 and 92, 93 in axial alignment with the diagonals of the cross-piece 87.

According to one embodiment, the bearings 94 and 95 shown in FIG. 37 are permanently fixed to the end of the arms 96 and 97 during construction. As shown in FIG. 36, bearings 90 and 91 are mounted on supports the height of which can be adjusted, said supports comprising cylindroconical bodies 108 which cooperate with appropriate housings 109 provided in the base 1. During the positioning of the shaft 3 on the base 1, the conical body 104 of the spherical pivot joint 4 and the cylindroconical bodies 108 of the universal joint (88-95) rest respectively in the casing 106 and the housings 109 in the base 1. After fixing the spherical pivot joint 4, the bodies 108 are fixed into the housings 109 by means of a binding agent 110 (of polymerised resin or a filling of cement) which is injected. This method of construction facilitates the assembly of the shaft 3 with the base 1, and enables interference forces due to manufacturing inaccuracies to be overcome.

The damping devices, provided in at least two opposite bearings, for example 90, 91, are in the form of pads 111 shown in FIG. 3 between the bearings 94 and the trunnions 92 and comprise concentric cylindrical rings, alternately of elastomer and sheet metal, held together by adhesive or vulcanisation.

According to the embodiment illustrated in FIGS. 36 to 38, the cylindroconical bodies 108 and the end of the arms 96 and 97 support the pads 111 in which are fixed the trunnions 88, 89, 92, 93, the ends of which turn in the bearings 90, 91, 94, 95 provided in the cages 107.

According to another embodiment not illustrated, two opposite pivots can be arranged as described above, and the other two pivots can be formed by a bearing, fixed to the structure of the base 1 or the shaft 3, fitted with a pad 111 the inner lining of which, comprising a metal ring, serves as a bearing (90, 91, 94 or 95) for the trunnion (88, 89, 92 or 93) fixed on the cross-piece 87.

According to a preferred embodiment shown in FIG. 38, the pads 111 have on the inside and outside metal carriers 112, integral with the elastomer rings 113 and fixed on the trunnion 92 and in the bearing 94 without any possibility of sliding, rotational or longitudinal movements. The rotational movement between the trunnion 92 and the bearing 94 is obtained solely by resilient distortion of the elastomer rings 113.

These embodiments of the invention are considered to be illustrative only since other modifications will be readily discerned by those skilled in the pertinent technology. In any event, the scope of the invention is intended to be covered by both the letter and the spirit of the claims appended hereto.

We claim:

1. An oscillatable installation set up on a permanent site in a sea-bed, comprising:

a base located on the sea-bed, a vertical shaft resting on the base, a bridge supported on the shaft and protruding above water level, a spherical pivot joint connecting the shaft to the base, said pivot joint enabling the shaft to oscillate in all directions as the shaft is moved by surface currents, ballast means positioned to the shaft near the base, a water-tight means, positioned on the shaft near the bridge, for forming a cellular structure of a float arranged so as to ensure that the shaft returns to its vertical position, said shaft including lattice structure supported on the base by the pivot joint and connected near the bridge to the cellular structure of the float, said shaft also including an upper section means of reduced diameter, positioned at the water surface between the cellular structure of the float and the bridge, for reducing effects of surface currents;

wherein at least one oil drilling pipe is located in a free central part between the cylindrical elements forming the cellular structure of the float, said installation further comprising:

annular float means for supporting said at least one oil drilling pipe in a part thereof situated between the cylindrical elements, and guide means for keeping the at least one oil drilling pipe free between the cylindrical elements.

2. An oscillatable installation according to claim 1, wherein said guide means are made up of shafts provided in the free central part between the cylindrical elements forming the cellular structure of the float.

3. An oscillatable installation according to claim 1, wherein a head of said at least one oil drilling pipe is mounted so as to be located in open air.

4. A method for dismantling an underwater joint in an oscillatable installation which includes a shaft adapted to be mounted in water with an upper section of reduced diameter at the water surface, a base, and a pivot member interconnecting the bottom of the shaft with the base, said method comprising the steps of:

(a) removing a connection between an upper part of the pivot member and a casing located at the bottom of the shaft;

(b) bracing together the pivot member and a bush positioned between the bottom of the pivot member and the top of the base;

(c) disengaging completely the upper part of the pivot member from the casing by causing the shaft to rise by at least removing ballast stored at the bottom of the shaft;

(d) moving the shaft laterally;

(e) attaching the pivot member to a lifting means;

(f) removing a connection between the bush and a housing positioned in the top of the base; and (g) hoisting up the pivot member by the lifting means.

5. The method according to claim 4 further comprising the steps of:

installing thrust means between a lower part of the pivot member and the casing between steps (a) and (b); and operating the thrust means during step (c).

6. A method for assembling an underwater joint in an oscillatable installation which includes a shaft adapted to be mounted in water with an upper section of reduced diameter at the water surface, a base, and a pivot member interconnecting the bottom of the shaft with the base, said method comprising the steps of:

(a) suspending the pivot member by a lifting member and arranging cross-bracing means between the pivot member and a bush attached at a lower part of the pivot member;

(b) lowering the pivot member and placing the bush in a housing positioned in the top of the base;

(c) securing the bush to the housing;

(d) unfastening the lifting menas from the pivot member;

(e) injecting a filling into a space between the bush and the housing;

(f) bringing the shaft above the pivot member;

(g) lowering the shaft by ballasting so that a casing located at the bottom of the shaft sits upon an upper part of the pivot member;

(h) fixing the casing to the upper part of the pivot member;

(i) injecting a filling agent into a space between the casing and the upper part of the pivot member; and (j) dismantling the cross-bracing means between the pivot member and the bush attached to the lower part of the pivot member.

* * * * *